US010295201B2

(12) United States Patent
Wang et al.

(10) Patent No.: US 10,295,201 B2
(45) **Date of Patent: *May 21, 2019**

(54) WALL-MOUNTED AIR CONDITIONER

(71) Applicant: QINGDAO HAIER AIR CONDITIONER GENERAL CORP., LTD., Qingdao, Shandong (CN)

(72) Inventors: Yongtao Wang, Shandong (CN); Tingting Guan, Shandong (CN); Jian Li, Shandong (CN); Zhongni Wu, Shandong (CN); Baosheng Yan, Shandong (CN); Guangfen Jia, Shandong (CN)

(73) Assignee: QINGDAO HAIER AIR CONDITIONER GENERAL CORP., LTD., Qingdao, Shandong (CN)

( * ) Notice: Subject to any disclaimer, the term of this patent is extended or adjusted under 35 U.S.C. 154(b) by 190 days.

This patent is subject to a terminal disclaimer.

(21) Appl. No.: 15/109,535

(22) PCT Filed: Mar. 13, 2015

(86) PCT No.: PCT/CN2015/074190

§ 371 (c)(1),
(2) Date: Jul. 1, 2016

(87) PCT Pub. No.: WO2016/029677

PCT Pub. Date: Mar. 3, 2016

(65) Prior Publication Data

US 2016/0327285 A1 Nov. 10, 2016

(30) Foreign Application Priority Data

Aug. 29, 2014 (CN) ..... 2014 1 04343532

(51) Int. Cl.
*F24F 1/02* (2019.01)
*F24F 13/20* (2006.01)
(Continued)

(52) U.S. Cl.
CPC ..... *F24F 1/02* (2013.01); *F24F 1/0007* (2013.01); *F24F 1/0057* (2019.02); *F24F 13/20* (2013.01);
(Continued)

(58) Field of Classification Search
CPC ..... F24F 1/02; F24F 13/20
(Continued)

(56) References Cited

U.S. PATENT DOCUMENTS 4,154,149 A * 5/1979 Holford ..... F24F 13/062 454/312
4,158,990 A * 6/1979 Kurrle ..... F24F 11/04 454/311
(Continued)

*Primary Examiner* — Steven B McAllister
(74) *Attorney, Agent, or Firm* — Tim Tingkang Xia, Esq.; Locke Lord LLP

(57) ABSTRACT

The invention discloses a wall-mounted air conditioner including an indoor unit. The indoor unit includes a front housing and a rear housing forming housing, the housing is provided with main air intake portions, heat exchangers are disposed inside the housing, both orthographic projection of the front housing and the rear housing are circular or approximately circular, the rear housing is located within a limiting area of the front housing, a surface of the front housing is an arc surface in which an upper portion and a lower portion contract backwards and a middle portion protrudes forwards, and a lower portion of the front housing is provided with an air outlet. The wall-mounted air conditioner according to the invention improves a structure of an existing wall-mounted air conditioner and can output air backwards, thereby ensuring fast flow and temperature adjustment of indoor air.

8 Claims, 4 Drawing Sheets

(51) Int. Cl.
*F24F 1/0007* (2019.01)
*F24F 1/0057* (2019.01)

(52) U.S. Cl.
CPC ..... *F24F 2221/17* (2013.01); *F24F 2221/26* (2013.01)

(58) Field of Classification Search
USPC ..... 454/292, 299, 300, 354
See application file for complete search history.

(56) References Cited

U.S. PATENT DOCUMENTS 4,763,565 A * 8/1988 Brown ..... F24F 13/062 454/300
5,001,968 A * 3/1991 Sodec ..... F24F 3/044 454/292
5,211,605 A * 5/1993 Shiga ..... F24F 13/06 454/284
5,333,835 A * 8/1994 Smith ..... F24F 13/16 137/554
5,658,196 A * 8/1997 Swaim ..... F24F 13/062 454/292
5,954,580 A * 9/1999 Adib ..... F24F 13/062 454/300
6,119,463 A * 9/2000 Bell ..... B60H 1/00471 165/86
6,142,867 A * 11/2000 Lee ..... F24F 13/06 137/556.3
6,336,338 B1 * 1/2002 Koren ..... F24F 1/0003 62/262
6,692,223 B2 * 2/2004 Ikeda ..... F04D 17/04 165/122
6,797,028 B2 * 9/2004 Duffy ..... B01D 46/001 454/187
7,603,873 B2 * 10/2009 Tonin ..... F24F 1/027 62/262
8,640,466 B2 * 2/2014 Bell ..... F25B 21/02 165/166
9,933,168 B2 * 4/2018 Sun ..... F24F 1/0029
9,964,317 B2 * 5/2018 Chang ..... F24F 1/025
2001/0027086 A1 * 10/2001 Snyder ..... F04D 25/088 454/292
2004/0083740 A1 * 5/2004 Taban ..... B60H 1/00464 62/3.2
2004/0093886 A1 * 5/2004 Takeuchi ..... F24F 1/0007 62/259.1
2004/0244403 A1 * 12/2004 Kim ..... F04D 17/165 62/419
2005/0164626 A1 * 7/2005 Kloostra ..... F24F 13/062 3/62
2005/0193757 A1 * 9/2005 Lee ..... F24F 1/0007 62/317
2005/0260945 A1 * 11/2005 Mhatre ..... F24F 13/062 454/300
2006/0194534 A1 * 8/2006 Mhatre ..... F24F 13/084 454/265
2008/0064318 A1 * 3/2008 Wellner ..... F24F 13/078 454/292
2009/0170421 A1 * 7/2009 Adrian ..... F24F 7/06 454/349
2009/0253366 A1 * 10/2009 Brown ..... F24F 13/075 454/299
2009/0311951 A1 * 12/2009 Walkinshaw ..... B60H 3/0007 451/261
2010/0050682 A1 * 3/2010 Ariga ..... F24F 1/025 62/401
2011/0262114 A1 * 10/2011 Montgomery ..... F24F 1/025 392/365
2011/0269391 A1 * 11/2011 Brown ..... F24F 13/075 454/358
2012/0111045 A1 * 5/2012 Ikeda ..... F04D 17/04 62/262
2014/0273804 A1 * 9/2014 Glass, Jr. ..... B29C 45/006 454/310
2015/0013945 A1 * 1/2015 Choi ..... F24F 1/0007 165/121
2015/0198348 A1 * 7/2015 Hohmann ..... F24F 13/062 454/258
2015/0267929 A1 * 9/2015 Kim ..... F24F 11/30 62/89
2016/0084510 A1 * 3/2016 Sun ..... F24F 1/0018 62/426

* cited by examiner

WALL-MOUNTED AIR CONDITIONER

CROSS-REFERENCE TO RELATED APPLICATIONS

This application is a U.S. national phase application of PCT patent application Serial No. PCT/CN2015/074190, filed Mar. 13, 2015, and claims priority to and benefit of Chinese Patent Application No. 201410434353.2, filed Aug. 29, 2014 in the State Intellectual Property Office of P.R. China, which are incorporated herein by reference in their entireties.

FIELD OF THE INVENTION

The present invention relates generally to the field of air conditioning, and specifically, to an air conditioner, and more specifically, to a wall-mounted air conditioner.

BACKGROUND OF THE INVENTION

All indoor units of traditional wall-mounted air conditioners are stripe-shaped. The indoor units are provided with stripe-shaped air outlets. A cross-flow fan is disposed inside the indoor unit. Air from heat exchanging of a heat exchanger, driven by the interior cross-flow fan, is directly blown out of an air outlet.

With the improvement of living standards and the constant advancement of technologies, people are no longer satisfied with the traditional air conditioners, and personalized needs increasingly increase. Therefore, in the field of air conditioners, vertical air conditioners are constantly developed. Accordingly, vertical air conditioners having stripe-shaped air outlets, a vertical air conditioner outputting mixed air, and the like are emerged. However, because of limitations by installment positions, an air flow capability, and costs, a wall-mounted air conditioner does not break the traditional air conditioners, which limits the development of a wall-mounted air conditioner.

SUMMARY OF THE INVENTION

An objective of the present invention is to provide a wall-mounted air conditioner, so as to improve a traditional structure of an existing wall-mounted air conditioner and output air backwards, thereby ensuring fast flow and temperature adjustment of indoor air.

To implement the foregoing objective of the present invention, the following technical solutions are used by the present invention for implementation:

A wall-mounted air conditioner includes an indoor unit, where the indoor unit includes a front housing and a rear housing forming housing, the housing is provided with main air intake portions, heat exchangers are disposed inside the housing, orthographic projection of the front housing and the rear housing are both circular or approximately circular, the rear housing is located within a limiting area of the front housing, a surface of the front housing is an arc surface in which an upper portion and a lower portion contract backwards and a middle portion protrudes forwards, and an air outlet is formed in a lower portion of the front housing.

According to the wall-mounted air conditioner as described above, the air outlet is formed in the lower portion of the front housing in an inclined direction in which an upper portion is forward, and a lower portion is backward, and an inclined angle of the air outlet is 4°-45°.

According to the wall-mounted air conditioner as described above, the front housing includes a front panel and a decoration plate that is located at a front surface of the front panel and is connected to the front panel.

According to the wall-mounted air conditioner as described above, the front housing further includes a decoration cover disposed at an edge of the air outlet.

According to the wall-mounted air conditioner as described above, the rear housing includes a rear plate and a side wall, the front housing is connected to the side wall, and the main air intake portion is disposed on the side wall.

Preferably, the main air intake portion includes multiple air inlets that are not connected to each other.

According to the wall-mounted air conditioner as described above, a non-hot exchange air inlet is formed on the rear housing at a position corresponding to the air outlet, an air delivery apparatus is disposed inside the housing, the air delivery apparatus includes at least two air-duct bodies each having front and rear openings, the air-duct bodies are sequentially arranged next to one another to form a throughway air passage therebetween, the throughway air passage connects the air outlet and the non-hot exchange air inlet, a hot exchange air passage is formed between two adjacent air-duct bodies of the air-duct bodies, a volute and a centrifugal fan located inside the volute are disposed inside the housing and above the air delivery apparatus, an air output portion of the volute faces the hot exchange air passage, the air output portion of the volute includes a surrounding portion that extends to the air delivery apparatus and that surrounds the hot exchange air passages, and air mixed cavities are formed between the surrounding portion and the hot exchange air passages.

According to the wall-mounted air conditioner as described above, a front opening of a front air-duct body, proximate to the air outlet, of the air delivery apparatus inclines downwards in a direction same with the air outlet.

According to the wall-mounted air conditioner as described above, the rear plate is provided with a breach, the breach includes a first surface connected to a mounting surface of the rear plate and a second surface far away from the mounting surface, and the non-hot exchange air inlet is disposed on the second surface.

According to the wall-mounted air conditioner as described above, the first surface is further provided with an air intake cavity, and a part of the non-hot exchange air inlet is located within the air intake cavity.

According to the wall-mounted air conditioner as described above, the mounting surface is provided with a wallboard.

Compared with the prior art, advantages and positive effects of the present invention are as follows:

According to the present invention, orthographic projections of a front housing and a rear housing of an indoor unit of a wall-mounted air conditioner are both set to be circular or approximately circular, the front housing is set to have an arc surface in which an upper portion and a lower portion contract inwards and a middle portion protrudes forwards, and an air outlet is formed in a lower portion of the front housing, which implements a structure that has a unique and nice appearance and that is totally different from an existing stripe-shaped wall-mounted air conditioner. In addition, according to the air conditioner in the present invention, it can be ensured that at the premise that an entire structure is as small as possible, there is enough inner space to accommodate inner components, so that an air direction is downward, which meets wall-mounted use of a wall-mounted air conditioner and ensures air adjustment performance of an air conditioner.

After specific implementation manners of the present invention are read with reference to the accompanying drawings, another feature and advantage of the present invention is clearer.

DETAILED DESCRIPTION OF THE INVENTION

To make the objectives, technical solutions, and advantages of the present invention clearer and more comprehensible, the following further describes the present invention in detail with reference to the accompanying drawings and embodiments.

A brief introduction is first made to technical terms involved in specific exemplary embodiments: "front", "rear", "left", and "right", which are referred to in the following, of each structure are defined relative to a position of a user in a state in which a structure member is normally used. Descriptions: "front", "rear", "left", and "right" on an arrangement position of multiple structure members are also defined relative to a position of a user in a state in which an apparatus formed of multiple structure members is normally used. Hot exchange air described below refers to air that is from an interior of an air conditioner and on which heat exchanging is performed by using a heat exchanger. Non-hot exchange air refers to air that is from environmental space in which an air conditioner is located and that is not directly from a heat exchanger relative to hot exchange air. Mixed air refers to air formed because of mixture of hot exchange air and non-hot exchange air.

Refer to an embodiment, which is shown in FIG. 1 to FIG. 6, of a wall-mounted air conditioner according to the present invention, and specifically, an embodiment of a wall-mounted air conditioner indoor unit.

Figure 1:
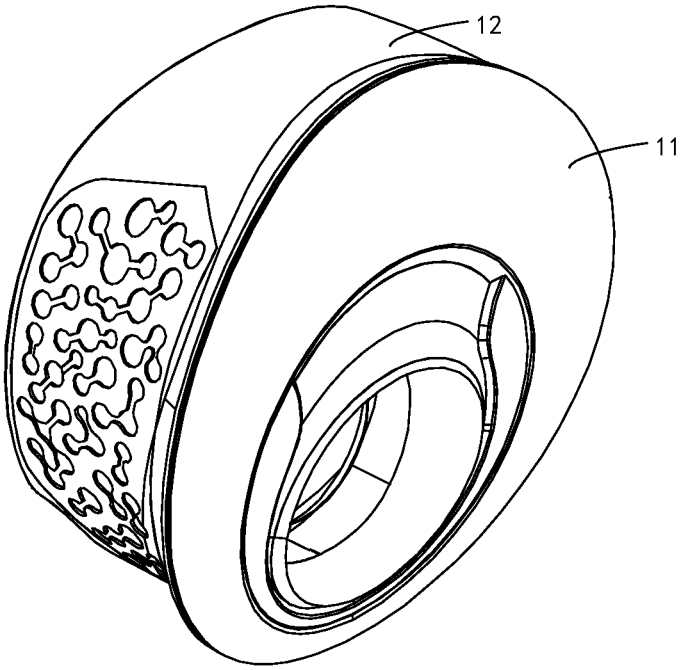
FIG. 1 is a perspective view of a wall-mounted air conditioner according to one embodiment of the present invention.
Figure 2:
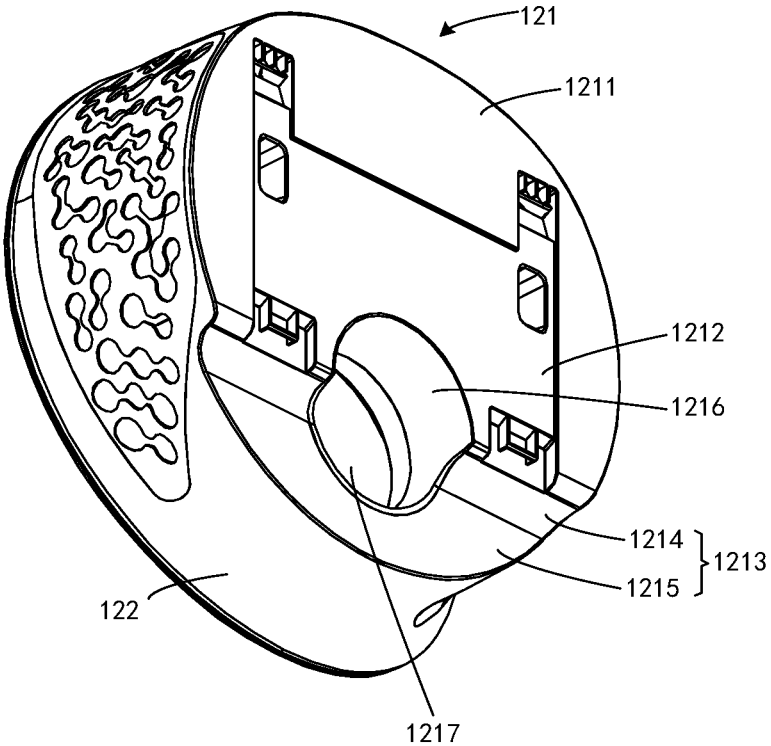
FIG. 2 is another perspective view of the wall-mounted air conditioner according to the embodiment of the present invention.
Figure 3:
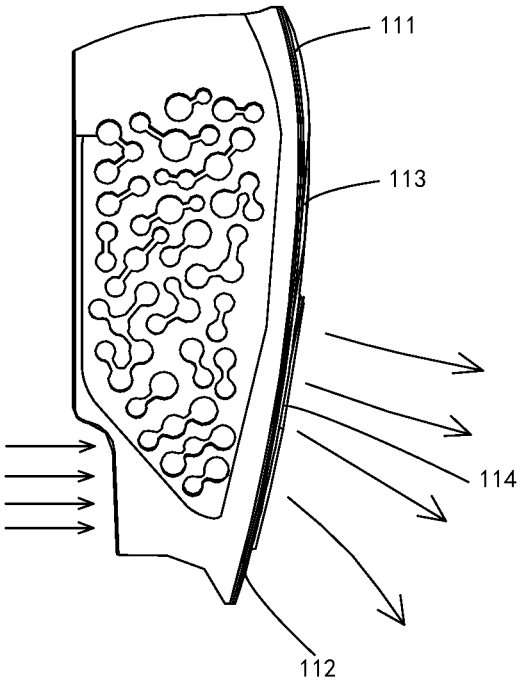
FIG. 3 is a side view of the wall-mounted air conditioner according to the embodiment of the present invention.
Figure 4:
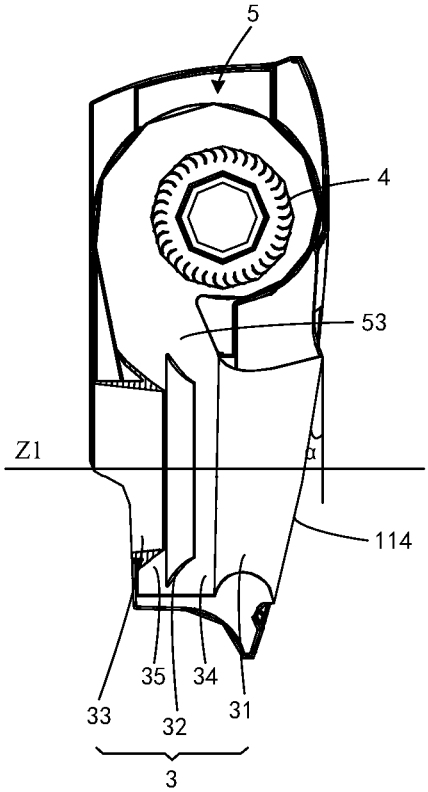
FIG. 4 is a sectional view of the wall-mounted air conditioner along a direction parallel with an axis of an air delivery apparatus according to the embodiment of the present invention.
Figure 5:
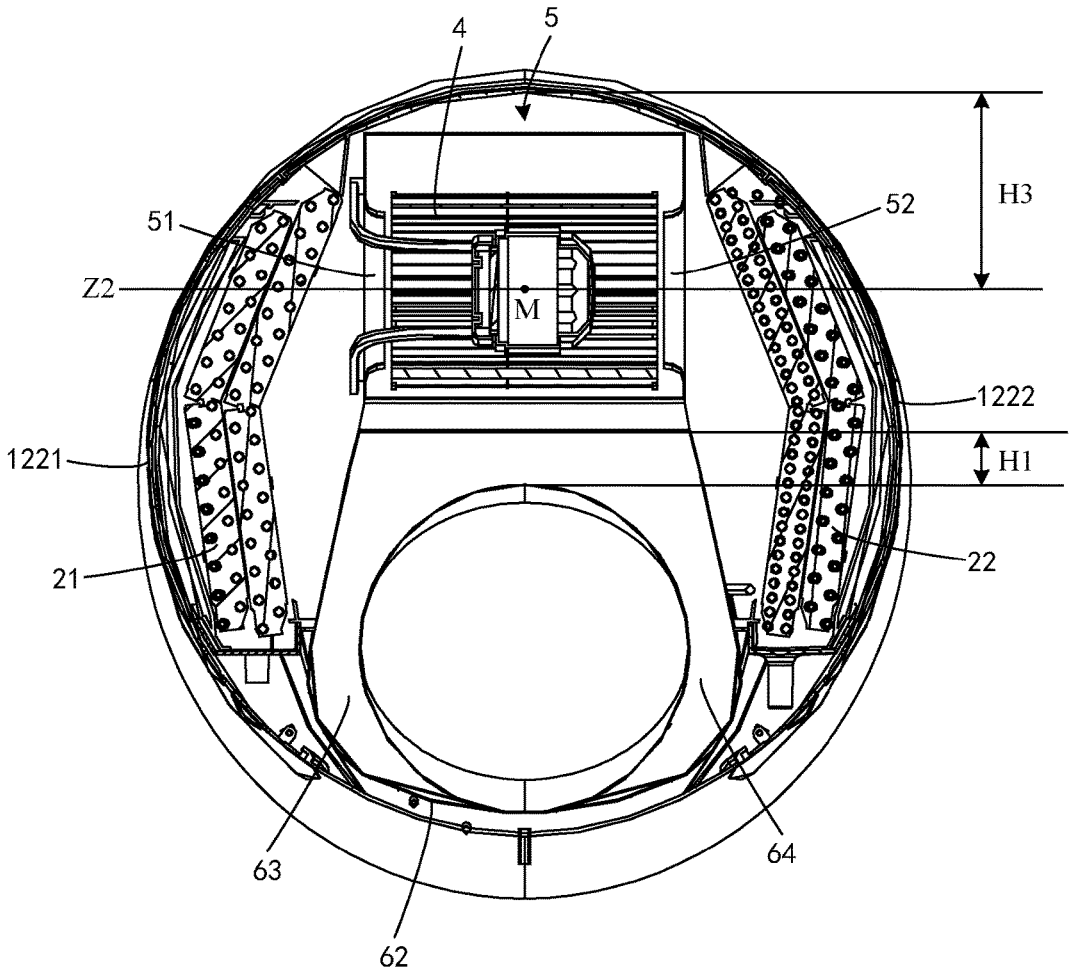
FIG. 5 is a sectional view of the wall-mounted air conditioner along a direction perpendicular to an axis of an air delivery apparatus according to the embodiment of the present invention.
Figure 6:
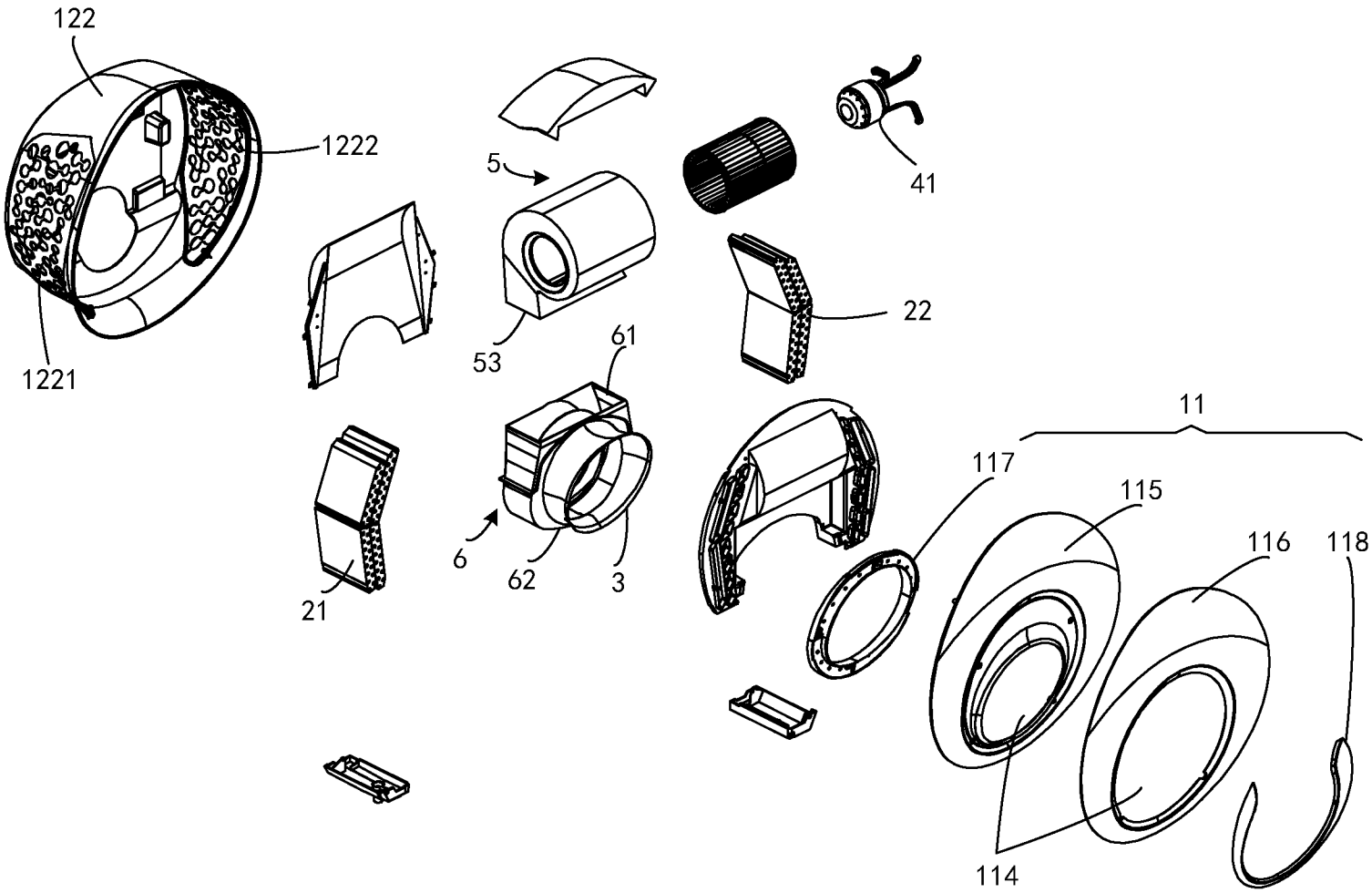
FIG. 6 is an exploded view of the wall-mounted air conditioner according to the embodiment of the present invention.

FIG. 1 and FIG. 2 are two solid figures of the embodiment, FIG. 3 is a side view of the embodiment, FIG. 4 and FIG. 5 are separately sectional views, which are along a direction parallel with and perpendicular to an axis of an air delivery apparatus, of the embodiment, and FIG. 6 is an exploded structural diagram of the embodiment.

The wall-mounted air conditioner in the embodiment includes an indoor unit, and the indoor unit includes a front housing 11 and a rear housing 12, and the two may be detachably connected, so as to form a housing of the indoor unit. Preferably, both orthographic projections of the front housing 11 and the rear housing 12 are circular or approximately circular, that is, both a peripheral profile (periphery) of the front housing and a peripheral profile (periphery) of the rear housing on the orthographic projections (which are not shown in the figure) are circular or approximately circular. Therefore, an orthographic projection of an entire indoor unit is also circular or approximately circular, so that an entire indoor unit has a unique and nice appearance, which is totally different from that of an existing stripe-shaped wall-mounted air conditioner indoor unit and meets a personalized aesthetic demand of a user.

Specifically, a structure of the front housing 11 is: for a surface of the front housing 11, both an upper portion 111 of the front housing and a lower portion 112 of the front housing contract backwards, and a middle portion 113 of the front housing protrudes forwards, so that the surface of the front housing 11 is an arc surface in which the upper portion and the lower portion contract inwards and the middle portion protrudes outwards. The rear housing 12 is located within a limiting area of the front housing 11. That is, on the orthographic projections, the peripheral profile (periphery) of the front housing 11 is located outside the peripheral profile (periphery) of the rear housing 12, as shown in FIG. 1. Therefore, an area presented by the wall-mounted air conditioner indoor unit is an area of the front housing 11. Because the upper portion and the lower portion of the front housing contract backwards, from the back of frontage, an outline size of the front housing 11 is small. In addition, the middle portion protrudes outwards, so that in a case in which the outline size is relatively small, a heat exchanger having a relatively large area and a centrifugal fan having a large air intake volume can be disposed inside the housing, to make the indoor unit meet an air volume requirement and a temperature adjustment requirement during air cooling and heating. The lower portion of the front housing 11, specifically, the lower portion 112 of the front housing, is provided with a mixed air outlet 114. The mixed air outlet 114 is disposed on the lower portion 112, whose surface contracts backwards, of the front housing, the mixed air outlet 114 is formed in an inclined direction in which the upper portion is forward, and the lower portion is backward, and an inclined angle of the mixed air outlet 114 is $\alpha$ meeting $4° < \alpha < 45°$. More preferably, the inclined angle is about 10°. The mixed air outlet 114 is set in this manner, in cooperation with structure design of a subsequent air delivery apparatus 3, so that air output from the mixed air outlet 114 can be blown forwards and backwards, which effectively avoids a problem that when the indoor unit is mounted at a relatively high position in a room and air output from an air outlet is blown up to a ceiling, an air volume and temperature adjustment of indoor flow air are affected.

Further, the front housing 11 includes a front panel 115, a decoration plate 116 and a decoration cover. The front panel 115 and the decoration plate 116 have a same outer profile and constitute a body of the front housing 11. The decoration plate 116 is located on a front surface of the front panel 115 and is connected to the front panel 115. For example, the decoration plate 116 is detachably connected to the front panel 115 by using a buckle and/or a screw; or is stuck to the front panel 115 by using glue. Same openings are formed on the front panel 115 and the decoration plate 116, and the two openings form the mixed air outlet 114. The decoration cover includes a detachably connected base 117 and a cover plate 118. The two components are buckledly mounted at an edge of the mixed air outlet 114 after being connected, thereby forming a decoration side of the mixed air outlet 114. Light in different colors may be set in the decoration cover to brighten the air outlet and give an instruction on output of air.

The rear housing 12, as a main part of the housing, has a thickness greater than a thickness of the front housing 11. Besides, a body of the rear housing 12 is of a cylinder-shaped structure and includes a rear plate 121 and a side wall 122. In the middle of the two parts, a relatively large accommodation space is formed by means of surrounding, so as to accommodate and place another component of the indoor unit, for example, the heat exchanger, a centrifugal fan, a water pan, and a volute. Left and right sides of the side wall 122 are symmetrically provided with a first main air intake portion 1221 and a second main air intake portion 1222. The two air intake portions preferably include multiple air inlets that are not connected to each other. Compared with an existing air intake grill, the air intake portion has a large air intake volume and easily clean dusts and sundries. When an integrity is formed, the front panel 115 in the front housing 11 is connected to the side wall 122. From the front of the indoor unit, both the first main air intake portion 1221 and the second main air intake portion 1222 are located within a limiting area of the front panel 115. Therefore, the mixed air outlet 114 disposed on the lower portion of the front housing 11 is relatively far away from the two main air intake portions, so that a problem that air of the air outlet and the air intake portion is mixed does not occur.

In addition, the rear plate 121 is provided with a mounting surface 1211, the mounting surface 1211 is provided with a wallboard 1212, and the indoor unit is fastened to and mounted on a wall by using the wallboard 1212. The rear plate 121 is further provided with a breach 1213, the breach 1213 includes a first surface 1214 perpendicular to and connected to the mounting surface 1211 and a second surface 1215 far away from the mounting surface 1211 and parallel with the mounting surface 1211, the second surface 1215 is provided with a non-hot exchange air inlet 1217, and a position of the non-hot exchange air inlet 1217 corresponds to that of the mixed air outlet 114 of the front housing 11. More preferably, the first surface 1214 is provided with an air intake cavity 1216, and the non-hot exchange air inlet 1217 is partially located in the air intake cavity 1216. The foregoing structure is used. After the indoor unit is mounted on the wall, an air intake empty cavity is preserved for the non-hot exchange air inlet 1217, thereby implementing unhindered air intake of the non-hot exchange air inlet 1217 and improving flow air performance of an air conditioner. In addition, an area of the mounting surface 1211 is not reduced and a mounting strength is not affected due to an excessively preserved empty cavity.

An interior of the housing formed of the front housing 11 and the rear housing 12 is provided with the heat exchanger, an air delivery apparatus 3, a centrifugal fan 4, a volute 5, and a surrounding portion 6.

Specifically, the air delivery apparatus 3 is disposed below and includes three air-duct bodies that are sequentially arranged from the front to the rear, that is, in a direction from the front housing 11 to the rear housing 12, which are separately a front air-duct body 31, a middle air-duct body 32, and a rear air-duct body 33. All of the three air-duct bodies that are sequentially arranged from the front to the back are ring-shaped. The front air-duct body 31 is go-through in the middle and has front and rear openings, which are separately a mixed air outlet and an air inlet (which are not shown in the figure). The middle air-duct body 32 is go-through in the middle and has front and rear openings, which are separately an air outlet and an air inlet (which are not shown in the figure). The rear air-duct body 33 is go-through in the middle and has front and rear openings, which are separately an air outlet and a non-hot exchange air inlet (which are not shown in the figure). After the front air-duct body 31, the middle air-duct body 32, and the rear air-duct body 33 are sequentially arranged from the front to the back, a throughway air passage (which is not shown in the figure) that goes through all of three air-duct bodies from the front to the back is disposed in the middle. In addition, the mixed air outlet 114 and the non-hot exchange air inlet 1217 are connected by means of the throughway air passage. A mixed air outlet of the front air-duct body 31 and the mixed air outlet 114 are interconnected, and a non-hot exchange air inlet of the rear air-duct body 33 and the non-hot exchange air inlet 1217 are interconnected. A first hot exchange air passage 34 is disposed between the front air-duct body 31 and the middle air-duct body 32, and a second ring-shaped hot exchange air passage 35 is disposed between the middle air-duct body 32 and the rear air-duct body 33. Moreover, both of the two hot exchange air passages are ring-shaped.

The centrifugal fan 4 is disposed above the air delivery apparatus 3 and is located inside the volute 5. The centrifugal fan 4 is preferably a double-suction-type centrifugal fan in which rotors of a motor 41 are externally disposed, and an axis z2 of the centrifugal fan 4 is perpendicular to an axis z1 of the air delivery apparatus 3. Further, internal space of the housing can be effectively used, and a fan length of the centrifugal fan 4 is increased to improve an air volume of the indoor unit and the heat exchange efficiency and reduce power consumption. Correspondingly, the volute 5 has the first air intake portion 51 and the second air intake portion 52 that are bilaterally symmetrical. Openings of the two air intake portions face outwards and can take in air from left and right sides under the function of the centrifugal fan 4. An air output portion 53 of the volute 5 faces the air delivery apparatus 3, and specifically, faces the two hot exchange air passages of the air delivery apparatus 3. The air output portion 53 of the volute 5 is provided with a surrounding portion 6 that extends to the air delivery apparatus 3 and that surrounds two hot exchange air passages. Air mixed cavities are formed between the surrounding portion 6 and the two hot exchange air passages. Specifically, the air output portion 53 of the volute 5 faces the hot exchange air passage in an inclined direction in which an upper portion is backward and a lower portion is forward, and the surrounding portion 6 surrounds the hot exchange air passage in an inclined direction in which an upper portion is backward and a lower portion is forward. Therefore, air flown out of the volute 5 enters the air mixed cavity and the hot exchange air passage at convenience in an inclined and downward direction and is output by means of the air delivery apparatus 3 in an inclined and downward inertial direction. Moreover, the surrounding portion 6 gradually expands downwards relative to the air delivery apparatus 3 from a starting end 61 of the surrounding portion 6 connecting to the air output portion 53 of the volute 5, so that an air mixed cavity 63 and a second mixed cavity 64 whose inner cavities gradually expand are formed on left and right sides of the air delivery apparatus 3. Moreover, the first air mixed cavity 63 and the second air mixed cavity 64 are bilaterally symmetrical by using a straight line perpendicular to the axis of the air delivery apparatus 3 as a symmetry axis. Therefore, hot exchange air flown out of the air output portion 53 of the volute 5 enters the first air mixed cavity 63 and the second air mixed cavity 64 under limiting and guiding of the surrounding portion 6. Carding and filling is performed on air currents in the two symmetrical air mixed cavities, and until the air mixed cavities are full, air on the left and right sides has an equal air volume and an equal air speed. Then, the air uniformly enters two ring-shaped hot exchange air passages in left and right and upward directions of the air delivery apparatus 3.

Moreover, in this embodiment, a distance between the top of the air delivery apparatus 3 and the air output portion 53 of the volute 5 is H1, and a distance between the bottom of the air delivery apparatus 3 and the bottom 62 of the surrounding portion is H2 (which is not shown in the figure), where H1 is greater than H2, and the air delivery apparatus 3 and the bottom 62 of the surrounding portion are close to a lower end of the housing as much as possible, so that a length of the surrounding portion 6 can be stretched, which provides an air mixed cavity that has an enough length to fully mix air together. In addition, a delivery area that has an enough length can be disposed between the surrounding portion 6 and the air output portion 53 of the volute 5, to implement static pressure recovery. In addition, to enable air that is blown out of the mixed air outlet 114 to move in an inclined and downward direction, besides that the mixed air outlet 114 and the mixed air outlet of the front air-duct body 31 interconnected with the mixed air outlet 114 are set to incline downwards in a direction in which an upper portion is forward and a lower portion is backward, the bottom of the air delivery apparatus 3 is close to or in contact with the bottom 62 of the surrounding portion as much as possible, so that only little air is blown out of bottoms of hot exchange air passages of the air delivery apparatus 3. After being blown out of upper and middle portions of the hot exchange air passages, most air is output along a throughway air passage and the mixed air outlet 114 in an inclined and downward direction.

More preferably, the first hot exchange air passage 34 and the second hot exchange air passage 35 are set in such a manner: For each hot exchange air passage, a size of an upper portion is greater than a size of a lower portion. For example, a width of the hot exchange air passage gradually contracts from up to down, thereby forming a passage structure that is wide at the upper portion and narrow at the lower portion. Because the hot exchange air passage is wide in the upper portion and narrow in the lower portion, air blown out of the air output portion 53 of the volute 5 is mostly blown out via a wider position of the hot exchange air passage, that is, the middle and upper portions, and further, can further enable the air output from the mixed air outlet 114 to move in an inclined and downward direction.

Further, the three air-duct bodies are set in such a manner: The three air-duct bodies are sequentially arranged in a column in a spacing-gradually-increased structure in a direction from the non-hot exchange air inlet 1217 to the mixed air outlet 114, so that sizes of the hot exchange air passages sequentially become large from the back to the front. That is, a size of the first hot exchange air passage 34 is greater than a size of the second hot exchange air passage 35. For example, a width of the first hot exchange air passage 34 is greater than a size of a corresponding position of a second hot exchange air passage 35. Setting like this can ensure that air that is output from a rear end of the air output portion 53 of the volute 5 and that has a relatively large air speed is fully guided to the throughway air passage, increase an air speed in the throughway air passage, and further increase an air volume of lured air from the non-hot exchange air 1217.

For the centrifugal fan 4, to ensure that efficiency of air intake from left and right sides and exchanging heat by means of an evaporimeter and whole machine vibration reach the standard, a distance H3 between an axle center M of the centrifugal fan 4 and the top of the housing ought to be not less than ¼ of an overall height of the housing.

In this embodiment, corresponding to the first main air intake portion 1221, the second main air intake portion 1222, and the centrifugal fan 4, the heat exchangers include a first heat exchanger 21 located between the first main air intake portion 1221 and the volute 5 and a second heat exchanger 22 located between the second main air intake portion 1222 and the volute 5. The first main air intake portion 1221 faces the first heat exchanger 21, and the second main air intake portion 1222 faces the second heat exchanger 22. Moreover, both the first heat exchanger 21 and the second heat exchanger 22 are two-folded and multi-layer heat exchangers, for example, two-folded and four-layer heat exchangers, and extend downwards from the volute 5 to surround a part of the surrounding portion 6. By means of design of this structure, it may be ensured that air of the external is taken into to a low-voltage region of a middle portion of the centrifugal fan 4 by using the main air intake portions and heat exchangers on two sides in a least-changed angle and shortest distance, thereby reducing a flow channel pressure loss, improving an indoor circulation air volume, and reducing noises of a whole machine. Moreover, air on which flow adjustment and static pressure recovery are performed by the centrifugal fan 4 is collected in the air mixed cavity and is blown out by the air delivery apparatus 3 out of the mixed air outlet 114. When the air is blown out, by using a pressure in the throughway air passage in the air delivery apparatus 3, non-hot exchange air is guided from the non-hot exchange air inlet 1217 to join final output of air, which increases an entire air intake volume of an air conditioner, speeds up flow of inner air, and further improves entire uniformity of indoor air. Moreover, mixed air like this is relatively gentle, and when the mixed air is blown to a body of a user, the user feels more comfortable, which improves an experience effect of suitability of the user.

The foregoing embodiments are merely intended for describing the technical solutions of the present invention but not for limiting the present invention. Although the present invention is described in detail with reference to the foregoing embodiments, persons of ordinary skill in the art may still make modifications to the technical solutions recorded in the foregoing embodiments or make equivalent replacements to some technical features thereof. These modifications or replacements do not make the essence of the corresponding technical solutions depart from the spirit and scope of the technical solutions of the present invention.

What is claimed is:

1. A wall-mounted air conditioner, which in heating mode creates hot air comprising:

an indoor unit, wherein the indoor unit comprises a front housing and a rear housing forming a housing, the housing is provided with main air intake portions, heat exchangers are disposed inside the housing, both orthographic projections of the front housing and the rear housing are circular or approximately circular, the rear housing is located within a limiting area of the front housing, a surface of the front housing is an arc surface in which an upper portion and a lower portion contract backwards and a middle portion protrudes forwards, and an air outlet is formed in a lower portion of the front housing, wherein the rear housing comprises a rear plate and a side wall, the front housing is connected to the side wall, and the main air intake portions are disposed on the side wall;

wherein the main air intake portions comprise multiple air inlets that are not connected to each other;

and wherein a non-hot exchange air inlet is formed on the rear housing at a position corresponding to the air outlet, an air delivery apparatus is disposed inside the housing, the air delivery apparatus comprises a plurality of air-duct bodies each having front and rear openings, the a plurality of air-duct bodies are sequentially arranged next to one another to form a throughway air passage therethrough, the throughway air passage connects the air outlet and the non-hot exchange air inlet, an at least one hot exchange air passage is formed between two adjacent air-duct bodies of the a plurality of air-duct bodies, a volute and a centrifugal fan located inside the volute are disposed inside the housing and above the air delivery apparatus, an air output portion of the volute faces the hot exchange air passage, the air output portion of the volute includes a surrounding portion that extends to the air delivery apparatus and that surrounds the at least one hot exchange air passages, and a plurality of air mixed cavities are formed between the surrounding portion and the at least one hot exchange air passages.

2. The wall-mounted air conditioner according to claim 1, wherein the air outlet is formed in the lower portion of the front housing in an inclined direction in which an upper portion is forward, and a lower portion is backward, and an inclined angle of the air outlet is 4°-45°.

3. The wall-mounted air conditioner according to claim 1, wherein the front housing comprises a front panel and a decoration plate that is located at a front surface of the front panel and is connected to the front panel.

4. The wall-mounted air conditioner according to claim 3, wherein the front housing further comprises a decoration cover disposed at an edge of the air outlet.

5. The wall-mounted air conditioner according to claim 1, wherein a front opening of a front air-duct body of the at least one air-duct bodies, proximate to the air outlet, of the air delivery apparatus inclines downwards in a direction same with the air outlet.

6. The wall-mounted air conditioner according to claim 1, wherein the rear plate is provided with a breach, the breach comprises a first surface connected to a mounting surface of the rear plate and a second surface far away from the mounting surface, and the non-hot exchange air inlet is disposed on the second surface.

7. The wall-mounted air conditioner according to claim 6, wherein the first surface is further provided with an air intake cavity, and a part of the non-hot exchange air inlet is located within the air intake cavity.

8. The wall-mounted air conditioner according to claim 6, wherein the mounting surface is provided with a wallboard.

* * * * *